United States Patent [19]

Lantz

[11] Patent Number: 5,052,996

[45] Date of Patent: Oct. 1, 1991

[54] CENTRIFUGAL SEPARATOR

[75] Inventor: Christer Lantz, Stocksund, Sweden

[73] Assignee: Alfa-Laval Separation AB, Tumba, Sweden

[21] Appl. No.: 487,961

[22] PCT Filed: Sep. 27, 1989

[86] PCT No.: PCT/SE89/00522

§ 371 Date: May 14, 1990

§ 102(e) Date: May 14, 1990

[87] PCT Pub. No.: WO90/04460

PCT Pub. Date: May 3, 1990

[30] Foreign Application Priority Data

Oct. 17, 1988 [SE] Sweden ..... 8803686

[51] Int. Cl.[5] ..... B04B 1/08

[52] U.S. Cl. ..... 494/68; 494/76

[58] Field of Search ..... 494/67, 68, 69, 70, 494/71, 72, 73, 74, 75, 66, 76, 77, 78; 210/781, 782, 360.1

[56] References Cited

U.S. PATENT DOCUMENTS

| | | | |
|---|---|---|---|
| 882,119 | 3/1908 | Ohlsson | 494/70 |
| 993,791 | 5/1911 | Ohlsson | 494/66 |
| 2,302,381 | 11/1942 | Scott | 494/68 |
| 3,335,946 | 8/1967 | Putterlik | 494/73 |
| 3,438,571 | 4/1969 | Murkes | 494/70 |
| 4,701,158 | 10/1987 | Inge et al. | 494/74 |

FOREIGN PATENT DOCUMENTS 17037 7/1901 Sweden .

*Primary Examiner*—Robert W. Jenkins

*Attorney, Agent, or Firm*—Seidel, Gonda, Lavorgna & Monaco

[57] ABSTRACT

The invention relates to a centrifugal separator with a rotor having a separation chamber, a stack of frustoconical separation discs arranged spaced from each other in the separation chamber coaxially with the rotor, and means defining centrally in the stack of separation discs radially inside thereof an inlet chamber. Inlet chamber is closed from connection with the separation chamber along the axial extension of the stack but communicates with the separation chamber at least at one end of the stack. The inlet means for introducing a liquid mixture into the inlet chamber and annular acceleration discs are placed coaxially with the rotor in the inlet chamber and arranged for gradual entrainment of incoming mixture in the rotation of the rotor. Each one of a plurality of the acceleration discs is made in one piece with a corresponding separation disc, so that a combination disc is formed, a plurality of such combination discs being arranged coaxially with the rotor and forming interspaces between adjacent combination discs. The central inlet chamber is delimited from the separation chamber by means of sealing members which close the interspaces between the combination discs thus formed.

12 Claims, 6 Drawing Sheets

CENTRIFUGAL SEPARATOR

The present invention relates to a centrifugal separator for the separation of different components of a liquid mixture thereof, comprising a rotor having a separation chamber, a stack of frusto-conical separation discs arranged in spaced relation to each other in the separation chamber coaxially with the rotor, means defining centrally in the stack of the separation discs radially inside thereof an inlet chamber for said mixture, which inlet chamber is closed from connection with the separation chamber along the axial extension of said stack but communicates with the separation chamber at least at one end of the stack, inlet means for introducing liquid mixture into the inlet chamber and annular acceleration discs placed coaxially with the rotor in the inlet chamber and arranged for gradual entrainment of incoming mixture in the rotation of the rotor. A centrifugal separator of this kind is shown for instance in U.S. Pat. No. 4,701,1578.

The use of acceleration discs of the above defined kind in the inlet chamber of a centrifuge rotor means an increase of the cost for the centrifuge rotor. This depends on costs for the acceleration discs themselves, for necessary means for fastening of the discs in the centrifuge rotor and for work with mounting of the discs in the centrifuge rotor.

The object of the present invention is to provide a new rotor design which is less complicated than the one to be seen from said U.S. Pat. No. 4,701,158 and which makes it possible to produce centrifuge rotors having acceleration discs to a lower cost than would be allowed by the rotor design according to U.S. Pat. No. 4,701,158.

This object may be achieved by designing a centrifugal separator of the initially defined kind such that each of at least some acceleration discs is made in one piece with a separation disc, so that a combination disc is formed, that said means defining the central inlet chamber closes the interspaces between adjacent combination discs and that the acceleration discs have through holes for axial transport within the inlet chamber of mixture having been brought in rotation by the acceleration discs.

By the invention there is no need for any separate means for fastening of the acceleration discs in the centrifuge rotor. Thereby, costs therefor have been eliminated and mounting of the acceleration discs has been made easier.

Within the scope of the invention said closing means may comprise separate gaskets arranged between the combination discs, but alternatively the combination discs themselves may be formed such that they will seal against each other around the central inlet chamber just by being axially kept together in their stack. The combination discs also may be permanently connected with each other by means of said closing means.

In a preferred embodiment of the invention the acceleration discs are substantially plane and the closing means is arranged between the radially outer portions thereof.

Figure 1:
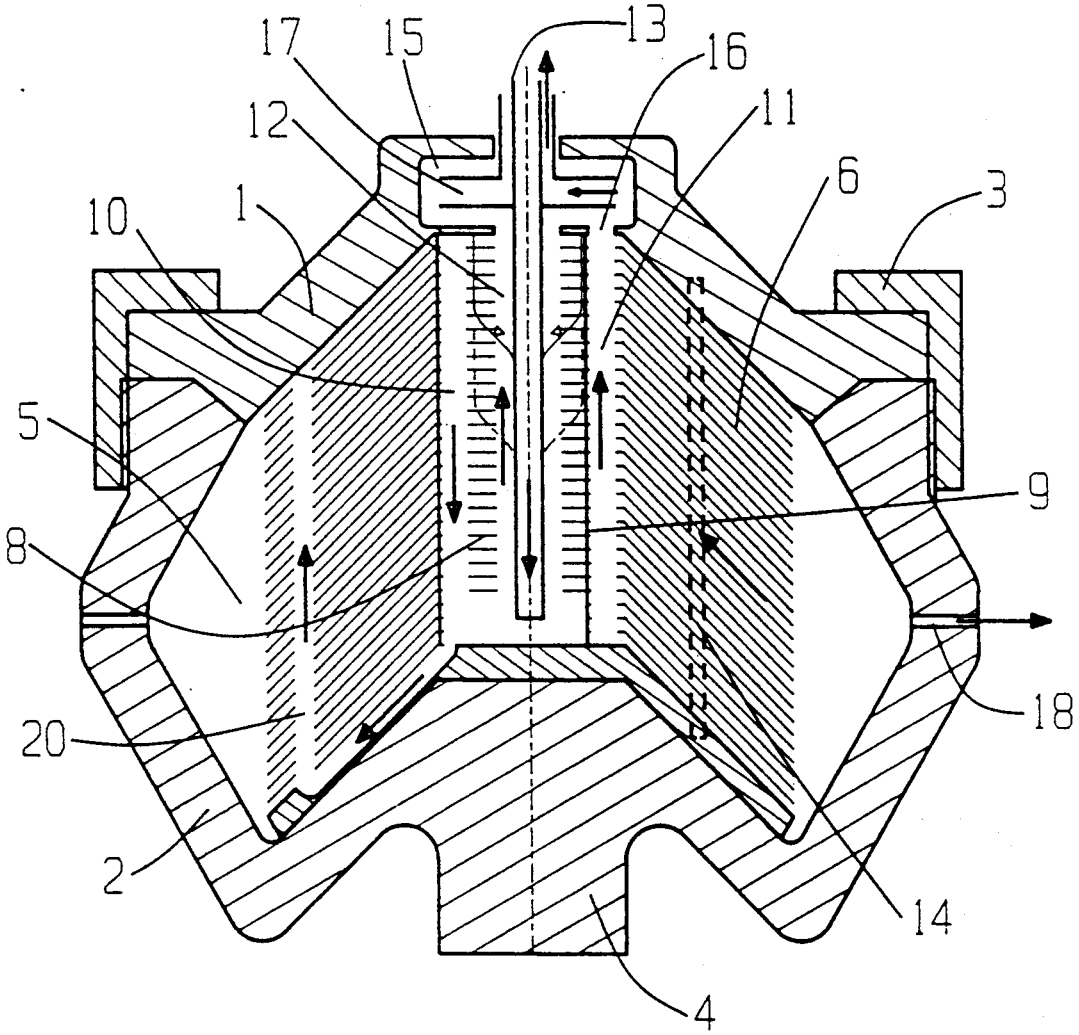
Figure 2:
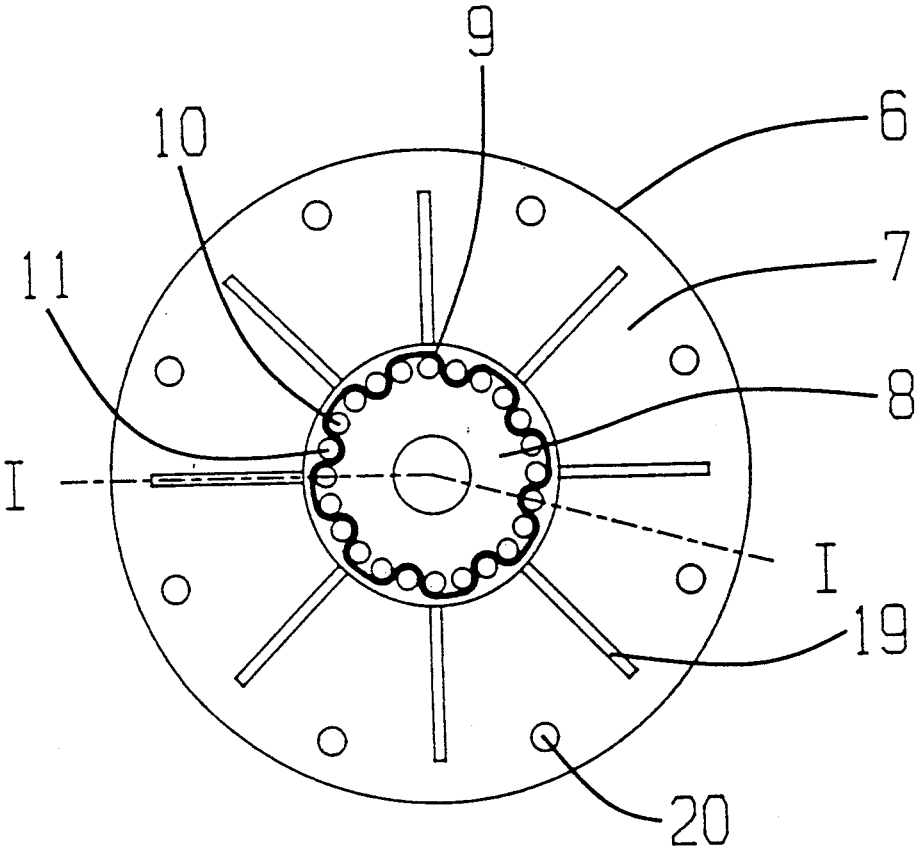
Figure 3:
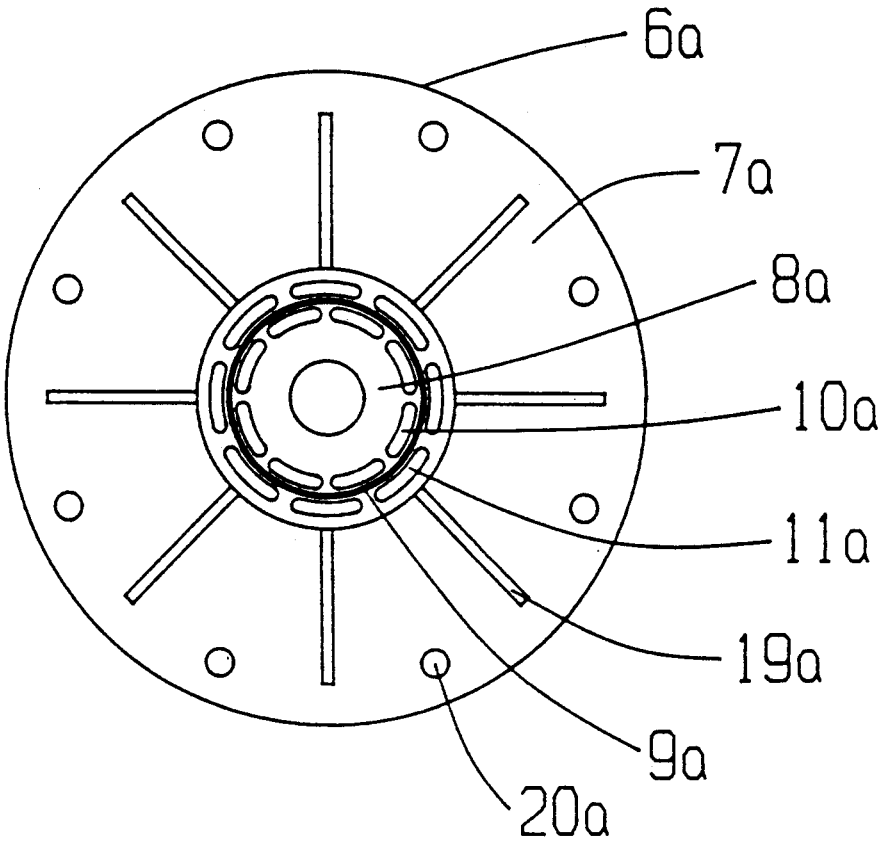
Figure 4:
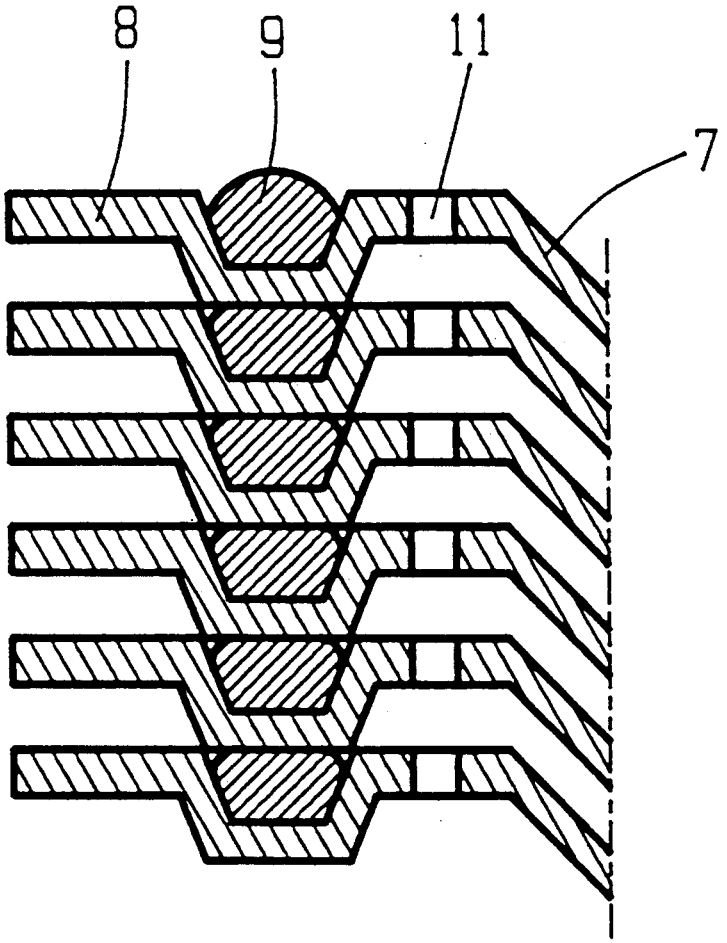

The invention is described below with reference to the accompanying drawing, in which FIG. 1 shows an axial section through a centrifuge rotor designed according to the invention, FIG. 2 shows a partly conical combination disc, seen from above, of the kind used in the centrifuge rotor in FIG. 1, a section line I—I in FIG. 2 illustrating which axial section is shown in FIG. 1., FIG. 3 shows another embodiment of a partly conical combination disc, FIG. 4 shows an example of gasket means arranged in the way shown in FIG. 2 between adjacent combination discs.

Figure 5:
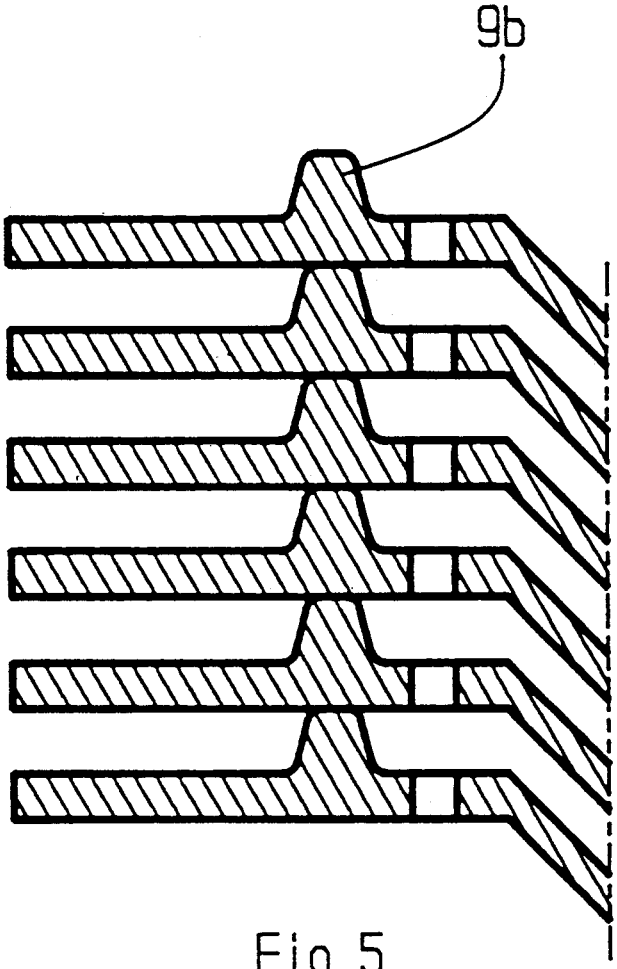
Figure 6:
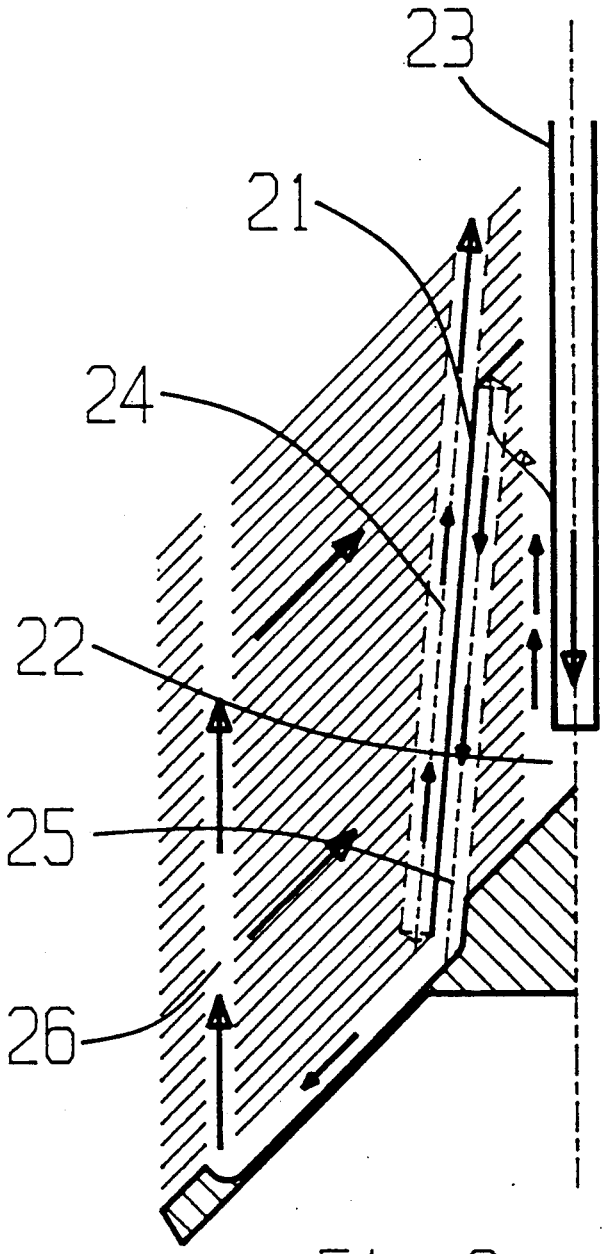

FIG. 5 shows another example of how adjacent combination discs may seal against each other, sealing means being formed in the discs and extending in the way shown in FIG. 2, and FIG. 6 shows a special embodiment of a stack of combination discs which in their entirety are frusto-conical.

FIG. 1 shows schematically a centrifuge rotor, the rotor body of which comprises an upper part 1 and a lower part 2, which parts are axially kept together by means of a locking ring 3. The rotor body is supported by a vertical drive shaft 4.

Within the rotor there is formed a separation chamber 5, in which there is arranged a stack of partly conical discs 6 which will be named combination discs below. A combination disc of this kind is shown in FIG. 2 seen from above with reference to FIG. 1.

Each combination disc 6 has a frusto-conical portion 7, which forms a separation disc in the separation chamber 5, and a central annular, plane portion 8. The plane portion 8 has several through holes situated in a ring around the rotor axis. Further, the plane portion 8 has a sealing member 9 which, as can be seen from FIG. 2, extends in a way such around the rotor axis that certain holes 10 will be situated radially inside the sealing member 9, whereas other holes 11 are left radially outside thereof.

In the stack of combination discs 6 the sealing members 9, as can be seen from FIG. 1, will close the interspaces between adjacent combination discs 6 in a way such that a central inlet chamber 12 is formed in the rotor, separated from the separation chamber 5. In the inlet chamber 12 the main part of each central plane portion 8 of each combination disc is situated, which during operation of the centrifuge rotor will act therein as an acceleration disc arranged gradually to entrain liquid in the rotation of the rotor.

The holes 10 in the different combination discs are situated axially aligned and form thereby a number of axial channels through the stack of discs radially inside the sealing members 9, i.e. within the inlet chamber 12, whereas the holes 11 correspondingly form axial channels radially outside the sealing members 9, i.e. in the separation chamber 5.

A stationary inlet pipe 13 for a liquid mixture of components to be separated extends into the inlet chamber 12 through the central holes in the discs 6. The inlet pipe opens in the lowermost part of the inlet chamber 12, and as can be seen from FIG. 1 the central parts of the plane portions 8 of the lowermost discs 6 have been removed in this area.

By dotted lines is indicated one of several axially through the stack of discs 6 extending rods 14, the ends of which are connected with the rotor body parts 1 and 2. Rods 14 of this kind may be used for mutual fixing of the discs 6 radially and in the circumferential direction of the rotor.

In the upper rotor body part 1 there is formed an outlet chamber 15 for one of the mixture components having been separated in the rotor. The outlet chamber 15 communicates through openings 16 in the rotor body part 1 with the axial channels formed by the holes 11 in the discs 6. The sealing member 9 of the uppermost disc 6 abuts sealingly against the underside of the rotor body part 1.

A stationary outlet member 17 in the form of a so called paring disc is supported by the inlet pipe 13 and extends into the outlet chamber 15.

A number of radial holes 18 through the radially outermost portion of the rotor part 2 are intended to form outlets for a separated relatively heavy component of the mixture supplied to the rotor.

It can be seen from FIG. 2 that each disc 6 on its upper side has a number of radially extending spacing members 19 of a conventional kind.

These spacing members 19 are arranged to abut against the underside of an adjacent disc 6 for the forming of flow passages between the discs. Further, each disc 6 near its radially outer edge has a number of holes 20 which are situated aligned with each other in the stack of discs, as can be seen from FIG. 1.

The centrifugal separator according to FIG. 1 is intended to operate in the following manner.

A liquid mixture consisting of for instance a liquid having suspended solids therein is supplied to the central chamber 12 in the rotor through the inlet pipe 13. The pipe 13 opens in the lowermost part of the inlet chamber 12.

The supplied mixture flows from the opening of the inlet pipe upwards in the inlet chamber 12 between the inlet pipe 13 and the inner edges of the plane portions 8 of the discs 6 and further radially outwards in the interspaces between these plane portions 8.

During the flow outwards in these interspaces the mixture is entrained gradually in the rotation of the rotor by the plane portions 8. These, thus, serve as acceleration discs for the mixture in the inlet chamber 12. When the mixture has reached out to the sealing members 9, it flows further axially downwards through the channels formed by the holes 10 in the acceleration discs 8. A free liquid surface is formed in the inlet chamber 12 at a level determined by the flow of mixture through the inlet pipe 13, for instance as illustrated by a full line and a triangle in the upper part of the inlet chamber 12. An alternative liquid level, corresponding to a reduced flow of mixture, is illustrated by a dotted line somewhat outside and below said full line. A venting channel which is not shown can extend between the upper part of the inlet chamber 12 and the outside of the rotor.

Mixture having reached the lower part of the inlet chamber 12 flows further on radially outward sin channels formed between the lowermost disc 6 and the rotor body 2. Then it flows axially upwards through channels which are formed by the aligned holes 20 in the separation discs 7 and into the interspaces between the separation discs.

The reason why the mixture in the inlet chamber 12 first flows axially upwards between the inlet pipe 13 and the inner edges of the acceleration discs—and does not flow directly from the opening of the inlet pipe 13 out into the separation chamber 5—is that the mixture does not rotate when it leaves the opening of the inlet pipe and, therefore, does not have a pressure as high as that of the rotating mixture present near the sealing members 9 in the lower part of the inlet chamber 12.

In the spaces between the separation discs 7 the suspended solids move radially outwards toward the undersides of the separation discs 7, along which they slide further on radially outwards to the radially outermost part of the separation chamber 5. They leave the rotor through its peripheral outlet openings 18.

Liquid freed from solids flows radially inwards between the separation discs 7 to the sealing members 9 and then axially upwards through the channels formed by the holes 11 in the separation discs 7. Liquid flows further on into the outlet chamber 15 through the openings 16 and its conducted out of the outlet chamber 15 and the rotor through the stationary outlet member 17.

FIG. 3 shows an alternative embodiment of a combination disc. It is designated 6*a* and has a frusto-conical portion 7*a* and a central plane portion 8*a*. The frusto-conical portion 7*a* has spacing members 19*a* and holes 20*a*. The plane portion 8*a* has two concentric rings of holes 10*a* and 11*a*, respectively, and between these rings of holes an annular sealing member 9*a*.

FIG. 4 shows an example of how sealing members 9 (or 9*a*) may be arranged in grooves having been pressed in the plane portions of the combination discs, i.e. in the acceleration discs 8.

FIG. 5 shows another example of how the combination discs may be arranged to seal against each other. In this case the discs preferably are made of plastic, an annular portion 9*b* of each disc being arranged to abut against an adjacent disc and serve as a sealing member when the stack of discs is kept axially together by the rotor body parts 1 and 2 (FIG. 1).

If desired, the combination discs, particularly if they are to be made of plastic, are formed in a way such that they releasably engage each other by means of so called snap-lock connections. Thereby, the discs may be assembled to a stack which can be dealt with as a unit but upon need be disassembled. The portions 9*b* shown in FIG. 5 in such a case may be formed so that snap lock connections of the said kind are obtained, which simultaneously form sealing means between the discs.

Within the scope of the invention it is alternatively possible to obtain the desired sealing between the combination discs by permanently connecting them with each other.

FIG. 6 shows schematically a stack of combination discs which preferably are made of plastic and permanently connected with each other.

By means of annular sealing members between the combination discs a conical wall 21 has been provided through the stack of discs, which wall 21 delimits an inlet chamber 22 from a surrounding separating chamber in he rotor. A stationary inlet pipe 23 extends into the inlet chamber 22.

After the combination discs have been assembled to a stack a number of channels 24 and 25 have been drilled from above and from below, respectively, through part of the stack. The channels 24 in the separation chamber correspond to the channels in FIG. 1 formed by the holes 11, and the channels 25 in the inlet chamber 22 correspond to the channels in FIG. 1 formed by the holes 10. Furthermore, the stack of combination discs has a number of channels 26 corresponding to the channels in FIG. 1 formed by the holes 20.

By means of arrows in FIG. 6 it is shown how a liquid mixture supplied through the inlet pipe 23 should flow through the inlet chamber 22 and the channels in the stack of combination discs. A free liquid surface in the inlet chamber 22 is shown by a full line and a triangle.

As is obvious, upon operation of a centrifuge rotor designed according to FIG. 6, the radially innermost conical portions of most of the combination discs will act as acceleration discs for gradual entrainment of incoming mixture in the rotation of the rotor.

Described above are only embodiments of the invention, in which a centrifuge rotor has the same number of acceleration discs as separation discs. Within the scope of the subsequent claims also embodiments of the invention are comprised, however, in which this is not the case. Thus, it may prove suitable for the obtainment of a desired acceleration of mixture entering the inlet chamber that the axial distance between adjacent acceleration discs is smaller than the distance between adjacent separation discs. Instead of having acceleration discs thicker than the respective separation discs, in such a case, one or more separate acceleration discs may be arranged in each interspace between two adjacent combination discs. Then, the combination discs as well as the separate acceleration discs preferably are provided with guiding members for engagement with each other, e.g. pegs and holes, for enabling a simple assembling of all of the discs in the centrifuge rotor.

I claim:

1. Centrifugal separator for the separation of different components of a liquid mixture thereof, comprising: a rotor being rotatable around a rotor axis and having a separation chamber, a stack of frusto-conical separation discs arranged spaced from each other in the separation chamber coaxially with the rotor, inlet chamber closing means defining centrally in the stack of separation discs radially inside thereof an inlet chamber for said mixture, the inlet chamber being closed from connection with the separation chamber along the axial extension of said stack and communicating with the separation chamber at least at one end of the stack, inlet means for introducing liquid mixture into the inlet chamber, a plurality of annular acceleration discs placed coaxially with the rotor in the inlet chamber and arranged for gradual entrainment of incoming mixture into the rotation of the rotor, wherein each one of a plurality of said acceleration discs is made in one piece with a corresponding separation disc, so that a combination disc is formed, a plurality of such combination discs being arranged coaxially with the rotor and forming interspaces between adjacent combination discs, said inlet chamber closing means closing the interspaces between adjacent combination discs, and the acceleration discs having through holes for axial transport of mixture brought into rotation by the acceleration discs.

2. Centrifugal separator according to claim 1, wherein the acceleration discs are substantially planar.

3. Centrifugal separator according to claim 2, wherein said inlet chamber closing means is arranged between the radially outer portions of adjacent acceleration discs.

4. Centrifugal separator according to claim 1, wherein said through holes in the acceleration discs are situated close to said inlet chamber closing means, the separation discs having similar through holes also situated close to said inlet chamber closing means for axial transport of separated liquid radially outside the inlet chamber closing means.

5. Centrifugal separator according to claim 4, wherein the through holes in the acceleration discs and the through holes in the separation discs are situated in a ring and substantially at the same distance from the rotor axis, and the inlet chamber closing means extends serpentine like around the rotor axis, so that the through holes in the acceleration discs will be situated radially inside of and the through holes in the separation discs will be situated radially outside of the inlet chamber closing means.

6. Centrifugal separation according to any of claims 1–5, wherein each of the combination discs is formed in one piece with an inlet chamber closing means arranged to sealingly abut against an adjacent combination disc.

7. Centrifugal separator according to any of claims 1–5, wherein said inlet chamber closing means comprises separate sealing members arranged between the combination discs.

8. Centrifugal separator according to any of claims 1–5, wherein the combination discs are permanently connected with each other by said inlet chamber closing means.

9. Centrifugal separator according to any of claims 1–5 wherein the combination discs are made of plastic material.

10. Centrifugal separator according to claim 6 wherein the combination discs are made of plastic material.

11. Centrifugal separator according to claim 8 wherein the combination discs are made of plastic material.

12. Centrifugal separator according to claim 3, wherein said through holes in the acceleration discs are situated close to said first inlet chamber closing means, the separation discs having similar through holes also situated close to said inlet chamber closing means for axially transport of separated liquid radially outside the inlet chamber closing means.

* * * * *